US008931314B2

(12) United States Patent
Yu

(10) Patent No.: US 8,931,314 B2
(45) **Date of Patent: *Jan. 13, 2015**

(54) PADLOCK

(71) Applicant: Fullyear-Brother Enterprise Co., Fu Shing Changwa (TW)

(72) Inventor: Chun Te Yu, Changhua County (TW)

(73) Assignees: Fullyear-Brother Enterprise Co., Fu Shing Changhwa (TW); Chun Te Yu, Fu Shing Changhwa (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/923,735

(22) Filed: Jun. 21, 2013

(65) Prior Publication Data

US 2013/0276486 A1 Oct. 24, 2013

Related U.S. Application Data

(63) Continuation of application No. 13/310,105, filed on Dec. 2, 2011, now Pat. No. 8,505,343, which is a continuation of application No. 10/671,659, filed on Sep. 29, 2003, now Pat. No. 8,091,391.

(60) Provisional application No. 60/443,331, filed on Jan. 29, 2003.

(30) Foreign Application Priority Data

Aug. 22, 2003 (TW) ..... 92215338 U

(51) Int. Cl.
*E05B 37/02* (2006.01)
*E05B 67/18* (2006.01)

(Continued)

(52) U.S. Cl.
CPC ..... *E05B 67/18* (2013.01); *E05B 35/105* (2013.01); *E05B 37/0034* (2013.01); *E05B 37/025* (2013.01)

USPC ..... 70/21; 70/25; 70/38 A; 70/38 B; 70/284; 70/285; 70/379 R

(58) Field of Classification Search
USPC ..... 70/21, 22, 24–26, 284, 285, DIG. 63, 70/DIG. 71, 30, 49, 38 R, 38 A, 38 B, 38 C, 70/29, 379 R, 379 A, 380, 52, 54–56, 70/DIG. 43, DIG. 56; D8/330–336, 338, D8/339, 341
See application file for complete search history.

(56) References Cited

U.S. PATENT DOCUMENTS 686,882 A 11/1901 Ballou
839,333 A 12/1906 Stolt (Continued)

FOREIGN PATENT DOCUMENTS

CN 2041340 U 7/1989

OTHER PUBLICATIONS

"Columbia Sportswear Company, Fall 2003/Spring 2004 Catalogue", Published Nov. 2002, pp. 1-4.

*Primary Examiner* — Lloyd Gall
(74) *Attorney, Agent, or Firm* — Muncy, Geissler, Olds & Lowe, P.C.

(57) ABSTRACT

A padlock can be unlocked by an owner dialing an unlocking number or security personnel using a general key. The padlock includes a housing, a block, a shackle, a general locking device and a private locking device. The housing includes a first channel and a second channel therein. The block is inserted in the second channel. The block includes a receptacle therein. The shackle includes a long arm movably disposed in the first channel and a short arm for engagement with the receptacle of the block. The general locking device is disposed in the housing for locking and unlocking the long arm of the shackle. The private locking mechanism is disposed in the housing for controlling the block so that the block can be engaged with and disengaged from the short arm of the shackle.

12 Claims, 7 Drawing Sheets

(51) Int. Cl.
*E05B 35/10* (2006.01)
*E05B 37/00* (2006.01)

(56) References Cited

U.S. PATENT DOCUMENTS

| | | | | | |
|---|---|---|---|---|---|
| 856,700 | A | | 6/1907 | Hoag | |
| 859,614 | A | | 7/1907 | Paddock | |
| 888,910 | A | | 5/1908 | Kreuzberger | |
| 980,798 | A | | 1/1911 | Krajdocha | |
| 1,408,771 | A | | 3/1922 | Nielsen | |
| 1,426,978 | A | | 8/1922 | Gambino | |
| 1,445,719 | A | | 2/1923 | Rozycki | |
| 1,462,869 | A | | 7/1923 | Primak | |
| 1,550,379 | A | | 8/1925 | Manteufel | |
| 1,564,463 | A | | 12/1925 | Best | |
| 1,622,999 | A | | 3/1927 | Frith | |
| 1,737,477 | A | | 11/1929 | Schmidt | |
| 2,497,619 | A | | 2/1950 | Mass | |
| 2,759,350 | A | | 8/1956 | Swanson | |
| 3,345,837 | A | | 10/1967 | Barnes | |
| 3,349,584 | A | | 10/1967 | Russell et al. | |
| 3,472,049 | A | | 10/1969 | Sewell | |
| 3,533,253 | A | | 10/1970 | Paul et al. | |
| 3,546,906 | A | | 12/1970 | Yang | |
| 3,559,429 | A | | 2/1971 | Hermann | |
| 3,729,962 | A | | 5/1973 | Harrington et al. | |
| 3,823,584 | A | * | 7/1974 | Gill | 70/21 |
| 3,894,415 | A | | 7/1975 | Bako | |
| 3,952,559 | A | | 4/1976 | Atkinson | |
| 4,138,868 | A | * | 2/1979 | Richards, Sr. | 70/38 A |
| RE30,243 | E | | 4/1980 | Oliver | |
| 4,462,231 | A | | 7/1984 | Zabel | |
| 4,829,795 | A | | 5/1989 | Taylor | |
| 4,876,866 | A | | 10/1989 | Fleming et al. | |
| 5,189,893 | A | * | 3/1993 | Kortenbrede | 70/38 A |
| 5,263,348 | A | | 11/1993 | Witter | |
| 5,363,678 | A | | 11/1994 | Mechbach | |
| 5,377,511 | A | * | 1/1995 | Meckbach | 70/38 A |
| 6,035,672 | A | | 3/2000 | Lai | |
| 6,085,558 | A | | 7/2000 | Strathmann | |
| D431,769 | S | | 10/2000 | Gast | |
| D450,560 | S | | 11/2001 | Yu | |
| 6,467,316 | B1 | | 10/2002 | Chen | |
| D470,743 | S | | 2/2003 | Koy | |
| 6,530,248 | B1 | | 3/2003 | Parker | |
| 6,644,076 | B2 | | 11/2003 | Huang | |
| 6,708,534 | B1 | | 3/2004 | Ruan | |
| 6,877,345 | B1 | | 4/2005 | Misner et al. | |
| 7,140,209 | B2 | | 11/2006 | Lai | |
| 7,174,756 | B2 | | 2/2007 | Ling et al. | |
| 7,340,927 | B2 | | 3/2008 | Yu et al. | |
| 7,424,812 | B2 | | 9/2008 | Loughlin et al. | |
| 7,434,426 | B2 | | 10/2008 | Loughlin et al. | |
| 7,493,785 | B2 | | 2/2009 | Yu et al. | |
| 7,913,526 | B2 | | 3/2011 | Loughlin et al. | |
| 8,091,391 | B2 | | 1/2012 | Yu et al. | |
| 8,505,343 | B2 | * | 8/2013 | Yu et al. | 70/21 |
| 2002/0088256 | A1 | | 7/2002 | Taylor et al. | |
| 2003/0000264 | A1 | | 1/2003 | Yang | |
| 2004/0226324 | A1 | | 11/2004 | Loughlin et al. | |
| 2005/0039501 | A1 | | 2/2005 | Yu | |
| 2005/0044901 | A1 | | 3/2005 | Yu | |
| 2005/0132762 | A1 | | 6/2005 | Yu | |
| 2006/0260369 | A1 | | 11/2006 | Lai | |
| 2007/0271969 | A9 | | 11/2007 | Yu et al. | |

* cited by examiner

PADLOCK

CROSS REFERENCE TO RELATED APPLICATION

This application is a Continuation of application Ser. No. 13/310,105, filed on Dec. 2, 2011, now U.S. Pat. No. 8,505,343, which is a Continuation of application Ser. No. 10/671,659, filed on Sep. 29, 2003, now U.S. Pat. No. 8,091,391, which is based on and claims the priority benefit of Taiwan Application Serial No. 092215338, filed on Aug. 22, 2003, and the priority benefit of U.S. Provisional Patent Application Ser. No. 60/443,331, filed on Jan. 29, 2003, each of which is hereby incorporated herein by reference in its entirety and made a part hereof.

BACKGROUND OF INVENTION

1. Field of Invention

The present invention relates to a padlock and, more particularly, to a padlock including a shackle locked by key-operable locking mechanism at an end and locked by combination locking mechanism at another end so that the padlock can be unlocked by using a key or dialing the combination locking mechanism to an unlocking number.

2. Related Prior Art

To prevent belongings from missing, travelers usually lock their trunks, suitcases, briefcases, bags or the like. A combination lock is the most common lock installed in a trunk because it takes little space. Each traveler sets up an unlocking number for the combination lock. Thereby, others cannot unlock his trunk without knowing the unlocking number. However, terrorists may use trunks to deliver explosives. In airports, security personnel may have to check travelers' trunks without their presence. In some countries, travelers are required not to lock their trunks. The travelers may lose their belongings if leaving their trunks unlocked. If the travelers lock their trunks, the security personnel are authorized to break the trunks for security check. There is a dilemma between the travelers' rights and the flight safety. Therefore, there is a need for padlocks that can protect the travelers' belongings and allow the security personnel to unlock them.

SUMMARY OF INVENTION

It is therefore an objective of the present invention to provide a padlock that can be unlocked by an owner dialing an unlocking number or security personnel using a general key.

According to the present invention, a padlock includes a housing, a block, a shackle, a general locking mechanism and a private locking mechanism. The housing includes a first channel and a second channel therein. The block is partly disposed in the second channel of the housing. The block includes a receptacle therein. The shackle includes a long arm movably disposed in the first channel and a short arm for insertion in the receptacle of the block. The general locking mechanism is disposed in the housing for locking and unlocking the long arm of the shackle. The private locking mechanism is disposed in the housing for controlling the block so that the block can be engaged with and disengaged from the short arm of the shackle.

BRIEF DESCRIPTION OF DRAWINGS

The present invention will be described via the detailed illustration of embodiments referring to the drawings wherein.

DETAILED DESCRIPTION OF EMBODIMENTS

Figure 1:
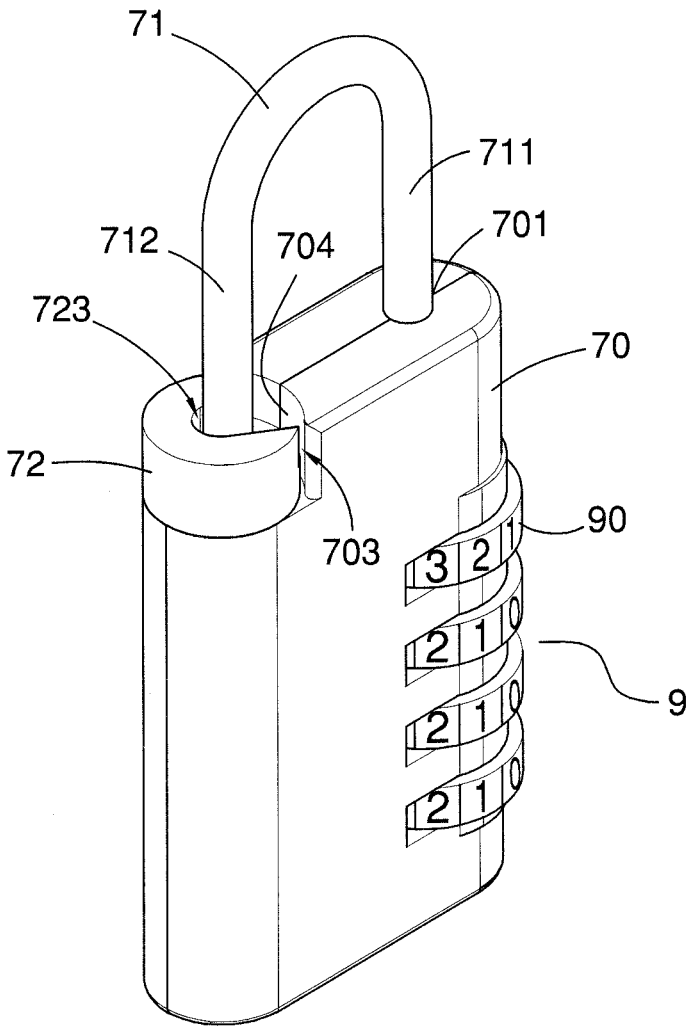
FIG. 1 is a perspective view of a padlock according to an embodiment of the present invention.

With reference to FIGS. 1 through 8, a padlock according to an embodiment of the present invention includes a housing 70, a block 72, a shackle 71, a combination locking mechanism 9 and a key-operable locking mechanism 8.

Figure 3:
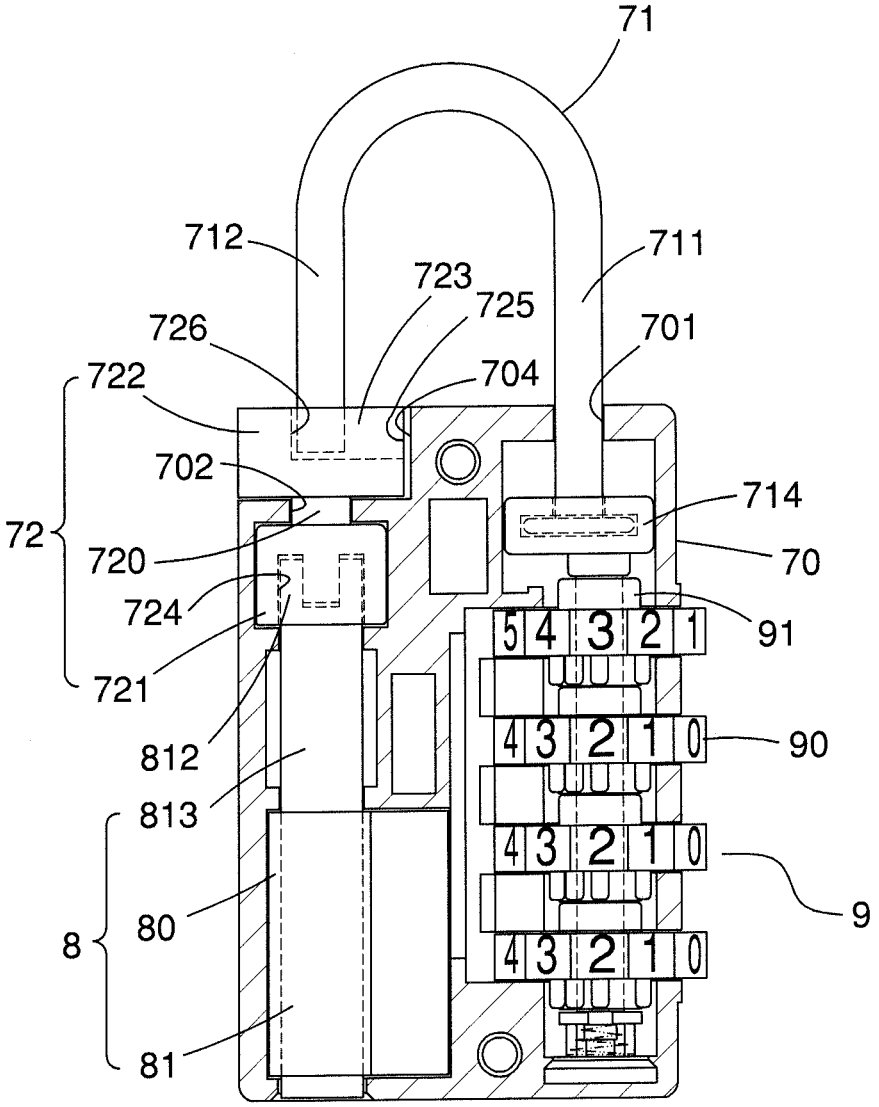
FIG. 3 is a cross-sectional view of the padlock shown in FIG. 1, showing a shackle locked.

As shown in FIG. 1, a space 703 is defined in a corner of the housing 70, and an outer wall 704 of the housing 70 faces the space 703. As shown in FIG. 3, the housing 70 further defines a first channel 701 and a second channel 702 in a top surface thereof.

Figure 4:
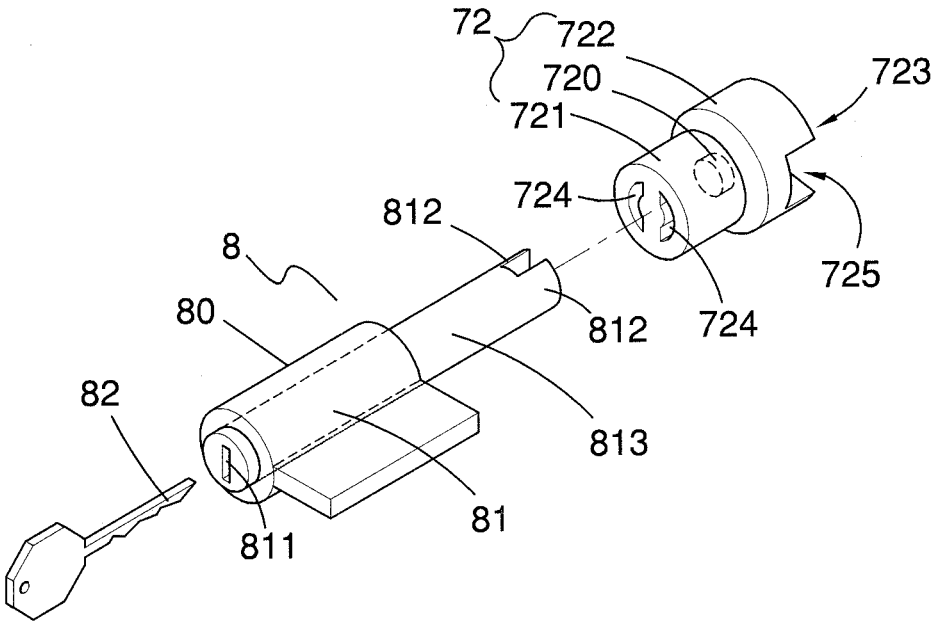
FIG. 4 is an exploded view of a key-operable locking mechanism and a block of the padlock shown in FIG. 1.

The block 72, which is a retaining structure, is movably disposed on the housing 70. As best seen in FIG. 4, the block 72 includes a mounting portion 721, an engaging portion 722 and a neck 720 connecting the mounting portion 721 and the engaging portion 722. Specifically, the mounting portion 721 of the block 72 is disposed inside the housing 70. The neck 720 of the block 72 is received in the second channel 702 of the housing 70. The engaging portion 722 of the block 72 is received in the space 703 of the housing 70. Moreover, the mounting portion 721 includes a pair of recesses 724 therein. The engaging portion 722 includes a receptacle 723 in a top and a gap 725 in a periphery and in communication with the receptacle 723. The diameter of the neck 720 is smaller than that of the mounting portion 721 and that of the engaging portion 722.

As shown in FIG. 3, the shackle 71 includes a long arm 711, which is a heel, partly received in the first channel 701 of the housing 70 and a short arm 712, which is a toe, extending from the long arm 711 and located outside the housing 70 for insertion in the receptacle 723 of the block 72. The long arm 711 of the shackle 71 is movable with respect to the housing 70 and includes a stop 714 at an end thereof. The size of the stop 714 is larger than that of an opening of the first channel 701 for preventing the long arm 711 from fully sliding off the first channel 701. The short arm 712 is rotatable about the longer arm 711 to or off a confining position. The diameter of the short arm 712 is smaller than the width of the gap 725 so that the short arm 712 can be moved through the gap 725.

Figure 2:
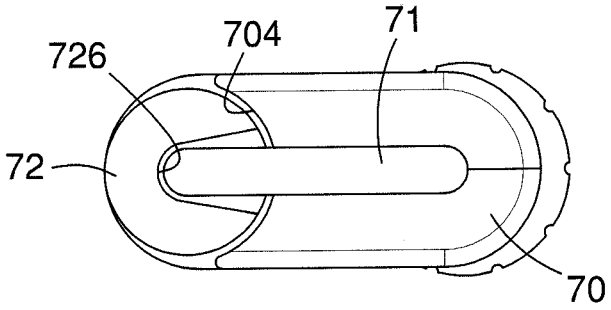
FIG. 2 is a top view of the padlock shown in FIG. 1.
Figure 7:
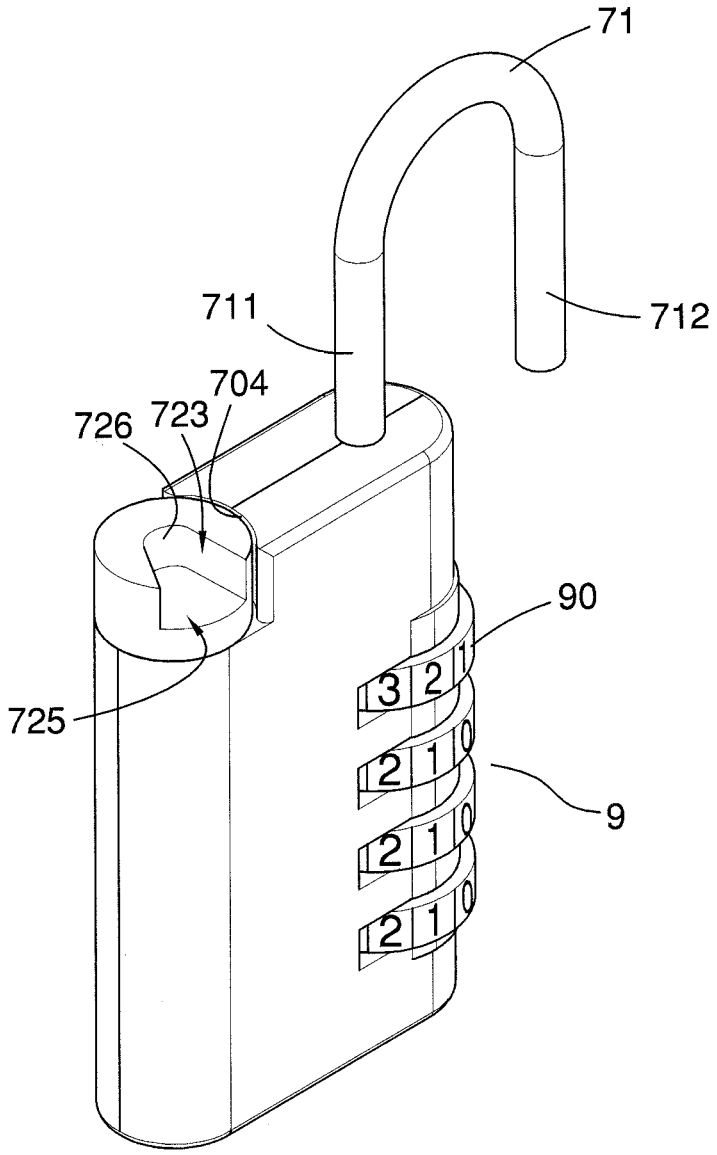
FIG. 7 is view similar to FIG. 6, showing that the short arm of the shackle is rotated off the engaging portion of the block.

As shown in FIGS. 1 through 3, the block 72 is located in a locking position and the short arm 712 of the shackle 71 is located in the confining position. At this time, the gap 725 of the block 72 is completely blocked by the wall 704 of the housing 70 and a distal end of the short arm 712 of the shackle 71 is enclosed by an inner wall of the block 726 and the wall 704 of the housing 70 so that the short arm 712 of the shackle 71 is restrained in the receptacle 723 of the block 72 and is not allowed to rotate off the confining position about the long arm 711 of the shackle 71. Preferably, the surfaces of the walls 726, 704 that together enclose the distal end of the short arm 712 are both arc surfaces, as best seen in FIGS. 2 and 7.

Figure 5:
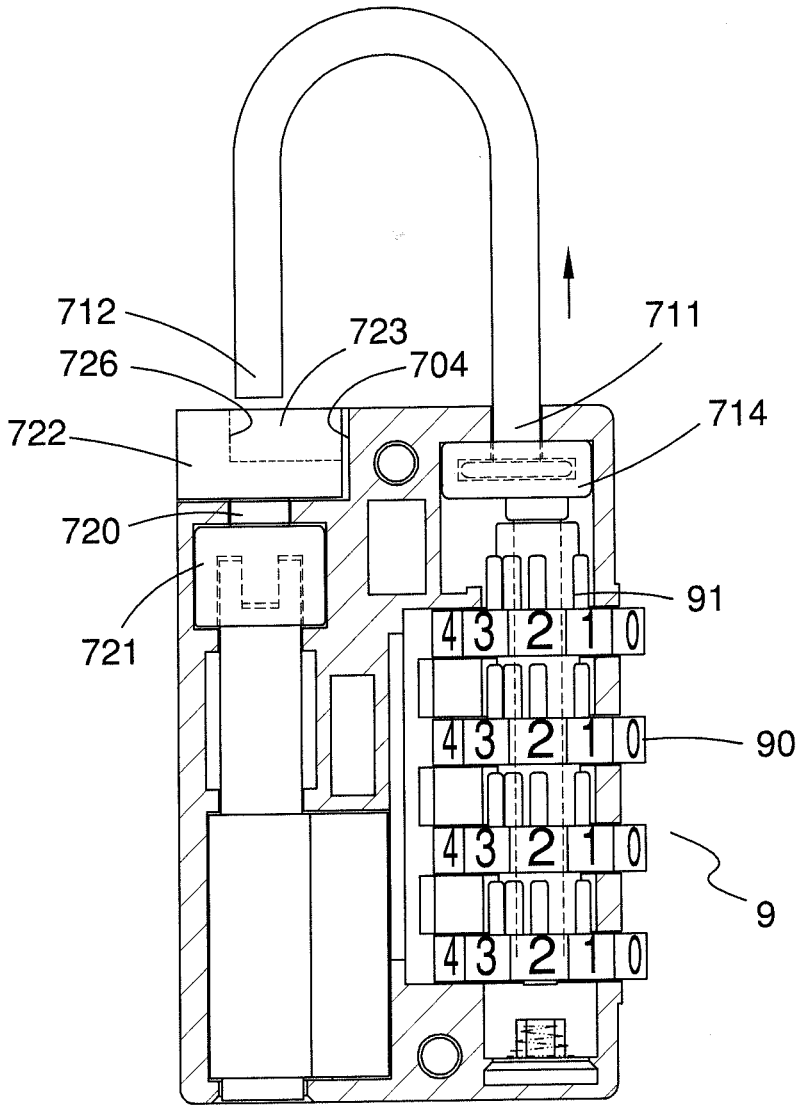
FIG. 5 is another cross-sectional view of the padlock shown in FIG. 1, showing a long arm of the shackle released from a combination locking mechanism of the padlock.

The combination locking mechanism 9 is disposed in the housing 70 for locking and unlocking the long arm 711 of the shackle 71. The combination locking mechanism 9 includes a stem 91 for engagement with the stop 714 of the long arm 711 of the shackle 71 and a plurality of numeral wheels 90 rotationally mounted on the stem 91 for locking and unlocking the long arm 711 of the shackle 71. When the combination locking mechanism 9 is dialed to an unlocking number, the stop 714 of the long arm 711 is released from the stem 91 and the long arm 711 is biased upwardly, as shown in FIG. 5, so that the short arm 712 is removed from the receptacle 723 of the engaging portion 722 of the block 72.

Referring back to FIG. 3, the key-operable locking mechanism 8 is disposed in the housing 70 for controlling rotation of the block 72 so that the block 72 can be engaged with and disengaged from the short arm 712 of the shackle 71. As best seen in FIG. 4, the key-operable locking mechanism 8 includes a body 80, a rotor 81 disposed in the body 80 and a driving rod 813 extended from the rotor 81. The rotor 81 includes a keyhole 811 therein for receiving a key 82. The driving rod 813 has an end formed with two plates 812 which are received in the respective recesses 724 of the mounting portion 721 of the block 72 so that the rotor 81 can be driven by the key 82 to rotate the block 72.

Figure 6:
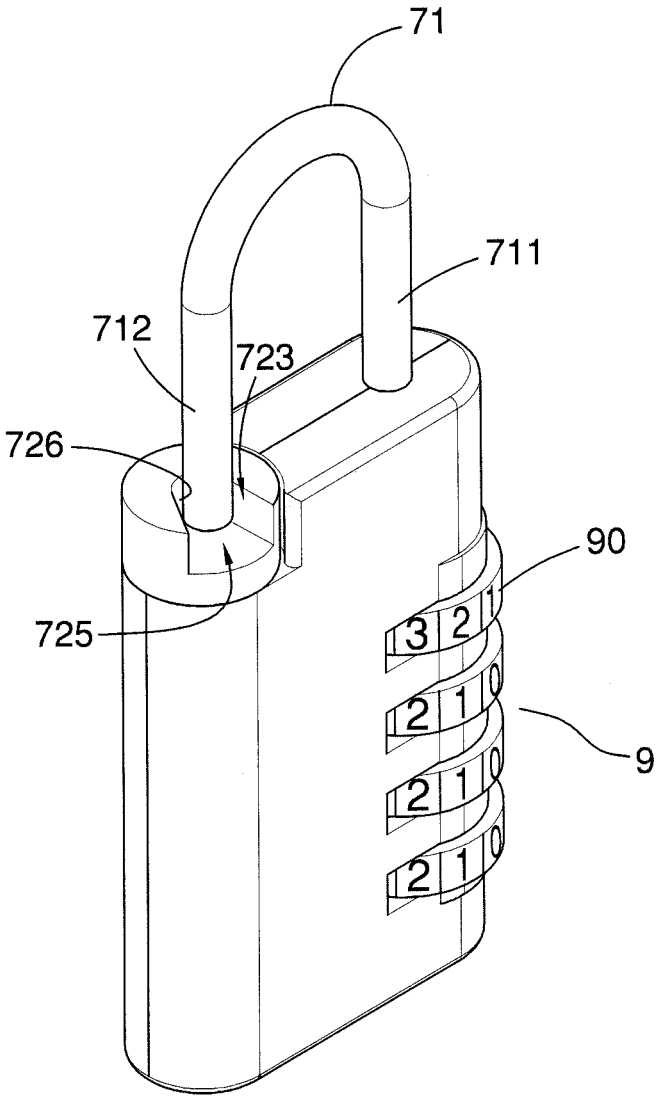
FIG. 6 is another perspective view of the padlock shown in FIG. 1, showing that an engaging portion of the block is rotated to a position for releasing a short arm of the shackle.
Figure 8:
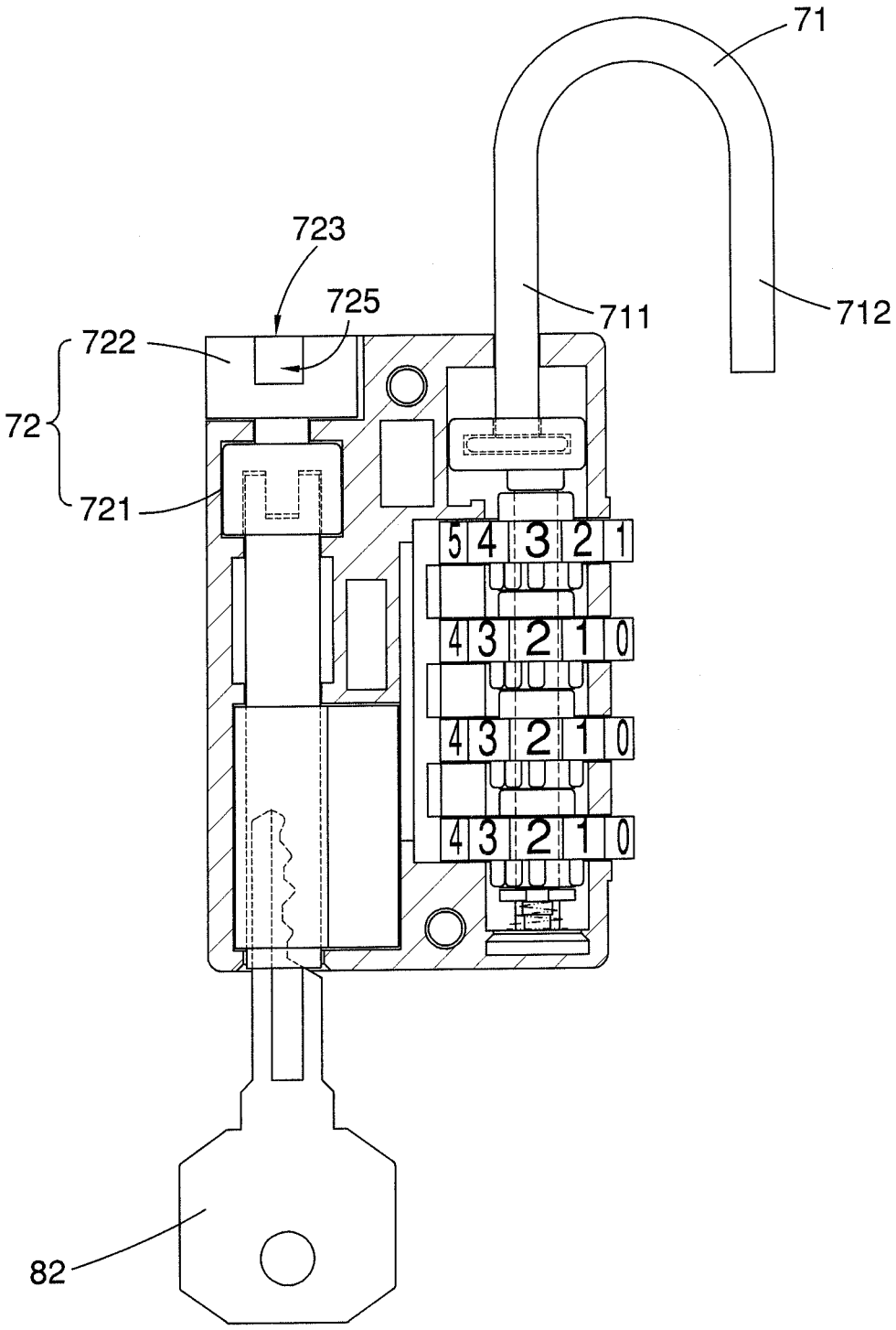
FIG. 8 is a cross-sectional view of the padlock shown in FIG. 7 and a key rotated in the key-operable locking mechanism of the padlock.

As mentioned above, the key 82 can rotate the rotor 81, which in turn will rotate the block 72 to an unlocking position. FIG. 6 illustrates that the block 72 is in the unlocking position and the short arm 712 of the shackle 71 is also located in the confining position. At this time, the gap 725 of the block 72 is not blocked by the wall 704 of the housing 70 and the distal end of the short arm 712 of the shackle 71 is no longer enclosed by the wall 726 of the block 72 and the wall 704 of the housing 70, and therefore the short arm 712 is free to rotate off the confining position about the long arm 711 and be removed from the receptacle 723 of the block 72 via the gap 725, as shown in FIG. 7 or 8.

The present invention has been described via the detailed illustration of the embodiment. Those skilled in the art can derive variations from the embodiment without departing from the scope of the present invention. Therefore, the embodiment shall not limit the scope of the present invention defined in the claims.

The invention claimed is:

1. A padlock comprising:

a housing having a wall;

a block disposed on the housing and being movable with respect to the housing to either one of a first position and a second position; wherein the block includes a receptacle in a top and a gap in a periphery and in communication with the receptacle; when the block is located in the first position, the gap is facing directly at the wall of the housing; and when the block is located in the second position, the gap is facing away from the wall of the housing; and a shackle having a long arm partly disposed in the housing, and a short arm extending from the long arm and located outside the housing; wherein the short arm is rotatable to or off a confining position about the long arm; wherein the short arm of the shackle has a distal end, when the block is located in the first position and the short arm of the shackle is located in the confining position, the distal end of the short arm of the shackle is in the receptacle of the block and the gap of the block is blocked by the wall of the housing; when the block is located in the second position, the gap of the block is no longer blocked by the wall of the housing, so that the distal end of the short arm of the shackle is allowed to access the receptacle of the block through the gap of the block.

2. A padlock comprising:

a body;

a shackle having a toe and a heel, the heel being retained by the body and able to rotate within the body;

a first and a second locking mechanism to lock the shackle, each of the locking mechanisms being enabled to independently unlock the shackle;

a retaining structure having a walled section and a non walled section, the retaining structure being movable between a first position and a second position by the first locking mechanism; and wherein when the second locking mechanism is in a locked position, when the toe of the shackle is above a surface of the body and when the retaining structure is in the first position, a first part of a perimeter of the toe is surrounded by the walled section of the retaining structure and a second part of the perimeter of the toe is surrounded by the body; and wherein when the second locking mechanism is in the locked position, and when the retaining structure is in the second position, the first part of the perimeter of the toe is not surrounded by the walled section and the toe is free to rotate about the heel.

3. The padlock of claim 2, wherein the body has a wall; and the retaining structure has a receptacle in a top and a gap in a periphery and in communication with the receptacle; when the retaining structure is located in the first position, the gap is facing directly at the wall of the body; and when the retaining structure is located in the second position, the gap is facing away from the wall of the body.

4. The padlock of claim 2, wherein the shackle is u-shaped.

5. The padlock of claim 2, wherein the first locking mechanism is disposed for controlling a rotation of the retaining structure between the first position and the second position.

6. The padlock of claim 2, wherein the first locking mechanism can be opened with a tool.

7. The padlock of claim 6, wherein the tool is a key.

8. The padlock of claim 2, wherein the padlock is locked in the first position and unlocked in the second position.

9. The padlock of claim 2, wherein when the retaining structure is in the first position and the second locking mechanism is in the locked position the toe cannot be moved past the walled section.

10. The padlock of claim 2, wherein when the second locking mechanism is in an unlocked position, the toe is free from the body and the walled section so the shackle can rotate about the heel.

11. The padlock of claim 10, wherein the first locking mechanism can be opened with a tool.

12. The padlock of claim 11, wherein the tool is a key.

* * * * *